US006123229A

United States Patent [19]

Barish

[11] Patent Number: 6,123,229

[45] Date of Patent: Sep. 26, 2000

[54] WATER DISCHARGE DEVICE PARTICULARLY USEFUL AS TOY WATER GUN

[76] Inventor: Benjamin J. Barish, 36 Yehuda Hanassi Street, Ramat Aviv, 69 206 Tel Aviv, Israel

[21] Appl. No.: 09/131,658

[22] Filed: Aug. 10, 1998

[30] Foreign Application Priority Data

Aug. 24, 1997 [IL] Israel ..... 121611

[51] Int. Cl.[7] ..... B65D 35/28; A63H 33/40

[52] U.S. Cl. ..... 222/79; 222/212; 446/180; 446/473; 137/475; 251/61

[58] Field of Search ..... 222/79, 206, 207, 222/386, 511, 212; 446/473, 475, 186, 220, 224, 180; 137/469, 475; 251/12, 61; 92/34, 90, 92

[56] References Cited

U.S. PATENT DOCUMENTS

| | | | |
|---|---|---|---|
| 4,257,460 | 3/1981 | Paranay et al. | 141/26 |
| 4,593,858 | 6/1986 | Pacht | 239/126 |
| 4,678,004 | 7/1987 | Rosenberg | 137/469 |
| 4,781,217 | 11/1988 | Rosenberg | 137/624.14 |
| 4,854,480 | 8/1989 | Shindo | 222/79 |
| 5,099,876 | 3/1992 | Rosenberg | 137/509 |
| 5,529,525 | 6/1996 | Deal | 222/212 |
| 5,758,800 | 6/1998 | D'Andrade | 222/79 |
| 5,799,828 | 9/1998 | Crawford | 222/79 |

*Primary Examiner*—Kevin Shaver
*Assistant Examiner*—Keats Quinalty
*Attorney, Agent, or Firm*—Benjamin J. Barish

[57] ABSTRACT

A water discharge device, particularly a toy water gun, includes a portable housing containing a reservoir for a quantity of water; a discharge control device for controlling the discharge of water from the housing; and a hand-operated pump for manually pumping water from the reservoir through the discharge control. The discharge control device includes an expansible chamber having an inlet connected to the pump, an outlet through which the water is discharged, and a pressure-responsive valve controlling the outlet. The valve is normally closed to permit expansion of the reservoir and a build-up of water pressure during the pumping of water by the pump into the reservoir, but automatically opens when a predetermined pressure is reached in the chamber to discharge water through the outlet.

20 Claims, 3 Drawing Sheets

WATER DISCHARGE DEVICE PARTICULARLY USEFUL AS TOY WATER GUN

FIELD AND BACKGROUND OF THE INVENTION

The present invention relates to novel water discharge devices. The invention is particularly useful in toy water guns for ejecting water from the gun barrel by the operation of a pump located within the handle of the toy gun, and is therefore described below with respect to this application.

The existing hand-operated toy water guns are generally capable of producing a single type of discharge, namely a continuous stream discharge having a range according to the force applied by the user to the hand-operated pump, typically the trigger of the toy gun. Examples of known devices are described in U.S. Pat. No. 2,678,753 (Hersey), U.S. Pat. No. 3,575,318 (Kunz), and U.S. Pat. No. 4,854,480 (Shindo). Luk U.S. Pat. No. 5,605,253 discloses a toy water gun which is capable of selectively producing two types of discharges: a continuous stream discharge, or a spray discharge.

In a completely non-related field, namely the water irrigation field, a number high of technology developments have been made in recent years for producing pulsations in the water discharged from the irrigating devices. These water pulsators, when included in specific types of water irrigation systems, have been found to be capable of effecting substantial savings in the water requirements of the irrigation system. Of particular interest are the developments by Peretz Rosenberg as described in his Israel Patents 74332 (U.S. Pat. No. 4,781,217), 72316 (U.S. Pat. No. 4,678,004), 93504 (U.S. Pat. No. 5,099,876), and his more recent developments described in his pending Israel Patent Applications 115969 (U.S. Pat. No. 5,950,676) and 121380 (U.S. Pat. No. 6,026,851). Such pulsator devices generally include an expansible chamber, a restrictor for restricting the inlet flow into the expansible chamber, and a pressure-responsive valve controlling the outlet from the chamber. The valve is normally closed to permit the chamber to expand by the water, supplied in a continuous, non-interrupted manner via the restrictor and the inlet, until the pressure within the chamber builds up to open the valve and to produce a pulse discharge, whereupon the valve closes to start a new cycle.

OBJECTS AND BRIEF SUMMARY OF THE INVENTION

An object of the present invention is to utilize such developments in the water irrigation field to produce novel water discharge devices having a number of important advantages as will be described more particularly below.

According to the present invention, there is provided a water discharge device, comprising: a portable housing containing a reservoir for a quantity of water; a discharge control for controlling the discharge of water from the housing; and a hand-operated pump for manually pumping water from the reservoir through the discharge control; the discharge control including an expansible chamber having an inlet connected to the pump, an outlet through which the water is discharged, and a pressure-responsive valve controlling the outlet; the valve being normally closed to permit expansion of the reservoir, and a build-up of water pressure therein during the pumping of water from the pump into the reservoir, but automatically opening when a predetermined pressure is reached in the reservoir to discharge water therefrom through said outlet.

According to further features in the described preferred embodiment, the discharge control further includes a manually presettable selector for presetting the predetermined opening pressure of the valve, thereby enabling presetting the velocity, or range of the water discharge through the outlet. Such a construction, when applied to a toy water gun, thus enables the user to preset the maximum range of the water gun according to the physical strength of the user to operate the hand pump.

According to additional features in the described preferred embodiments, the discharge control further includes a flow restrictor for restricting the flow into the expansible chamber to a lower rate than out of the chamber, such that immediately upon the discharge of water from the chamber, the valve automatically recloses until the predetermined pressure is again reached to open the valve.

In the described preferred embodiment, the discharge control includes a manually presettable flow rate selector for presetting the flow restrictor to a rate which is either sufficiently high to produce a continuous stream discharge, or sufficiently low to produce a plurality of short squirt discharges. Thus the user may preselect not only a continuous stream discharge as in toy water guns of the conventional type, but also short squirt discharges at any desired rate, ranging from a rapid burst of such short discharges, to time spaced discharges.

As will be described more fully below, the previous developments of Peretz Rosenberg in the pulsator-irrigation field have been found particularly advantageous for use as the expansible chamber and the pressure-responsive valve in the water discharge devices of the present invention. Particularly advantageous results are produced when the expansible chamber is of the bellows type, as described in his patent applications 115969 and 121380, since such a bellows construction stores energy in the expansible chamber according to the pressure therein, and immediately, when the valve opens, releases such energy to propel the liquid out of the outlet. However, it will be appreciated that other expansible chamber constructions, and/or other pressure-responsive valves, could also be used.

The foregoing features are particularly useful for constructing water discharge devices in the form of toy water guns, e.g. water pistols or water rifles. However, these features are also useful for constructing other water types of discharge devices, such as dental devices for cleaning teeth and/or massaging guns.

Further features, advantages and applications of the invention will be apparent from the description below.

BRIEF DESCRIPTION OF THE DRAWINGS

The invention is herein described by way of example only, with reference to the accompanying drawings, wherein.

DESCRIPTION OF A PREFERRED EMBODIMENT

Figure 1:
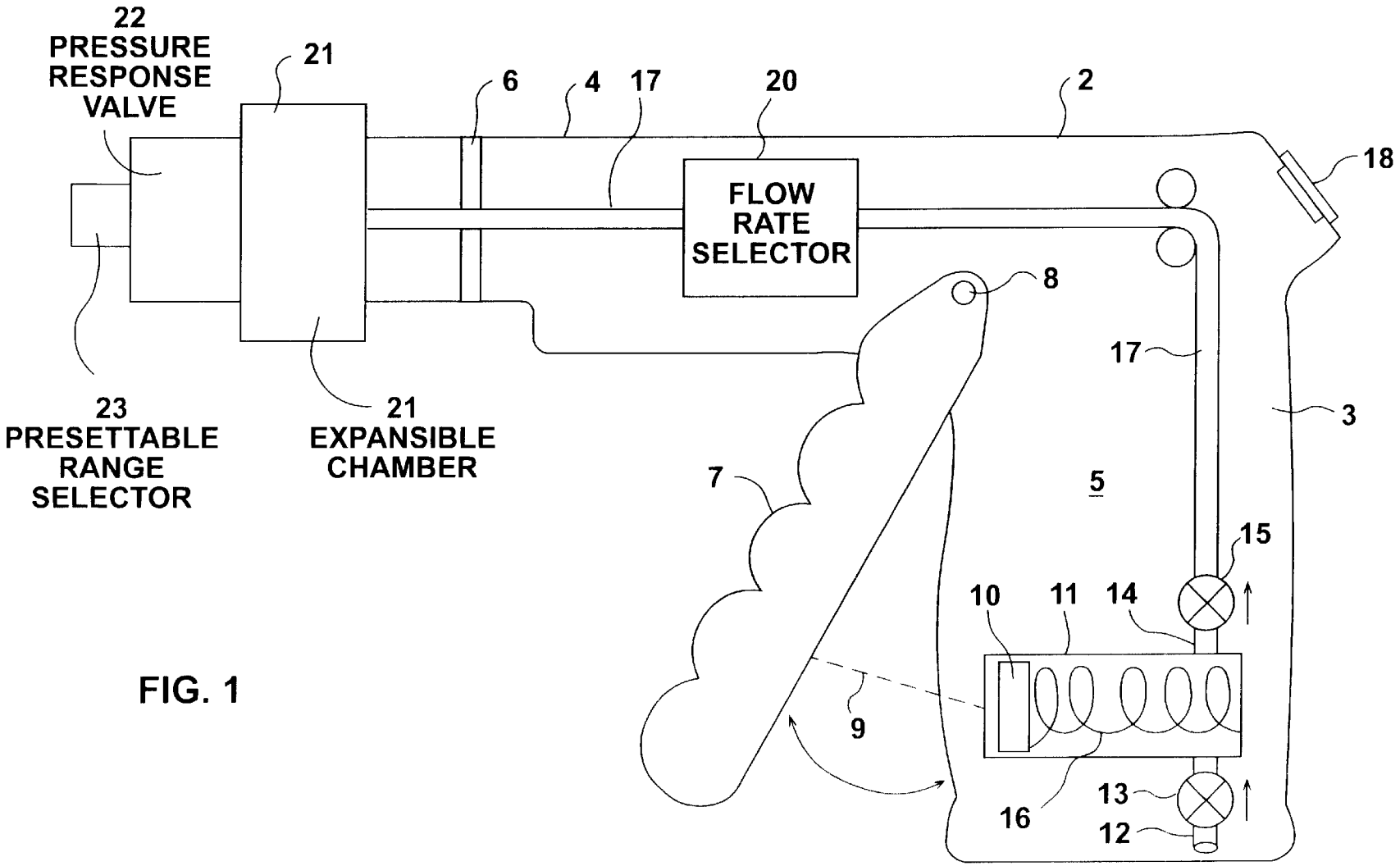
FIG. 1 is a diagramatic view illustrating one form of water discharge device, namely a toy water pistol, constructed in accordance with the present invention.

The water discharge device illustrated in FIG. 1 is a toy water gun, in the form of a pistol, including a housing 2 formed with a handle 3 for grasping by the user, and a barrel 4 through which the water is to be discharged. The water is contained within an internal reservoir 5 defined by housing 2 up to a barier 6 provided in the housing adjacent to the discharge end of the barrel 4.

The illustrated toy water pistol further includes a hand operated pump for manually pumping the water from the water reservoir 5 through the discharge end of barrel 4. In this case, the pump is hand-operated by a lever 7 pivotally mounted at its upper end 8 to housing 2 and coupled at its lower end, by a coupling shown schematically at 9, to a piston 10 movable within a cylinder 11. Cylinder 11 includes an inlet tube 12 leading to the bottom of the water reservoir within handle 5 and having a one-way valve 13 permitting water to flow only into the cylinder. The water is pumped out of the cylinder via an outlet tube 14 having a one-way valve 15 permitting the water to flow therethrough only out of the cylinder. A spring 16 within the cylinder urges piston 10 to its initial position illustrated in FIG. 1. Pivotting lever 7 towards handle 3 moves the piston to the opposite end of the cylinder to pump the water out of the cylinder and, via a feed tube 17, through the discharge end of the barrel 4. A removable refill cap 18 permits refilling the water reservoir 5 within handle 3 and barrel 4 up to the partition 6.

The illustrated water pistol further includes a control for controlling the discharge from barrel 4 when the hand-pump is operated by the user by pivotting lever 7. This discharge control includes: a flow rate selector located within the pistol barrel 4, as schematically indicated by block 20 in FIG. 1; an expansible chamber at the discharge end of barrel 4, as schematically indicated by block 21; a pressure-responsive valve controlling the outlet of expansible chamber 21, as schematically indicated by block 22; and a presettable range selector for controlling the velocity, and thereby the range, of the water discharge, as schematically indicated by block 23.

Figure 2:
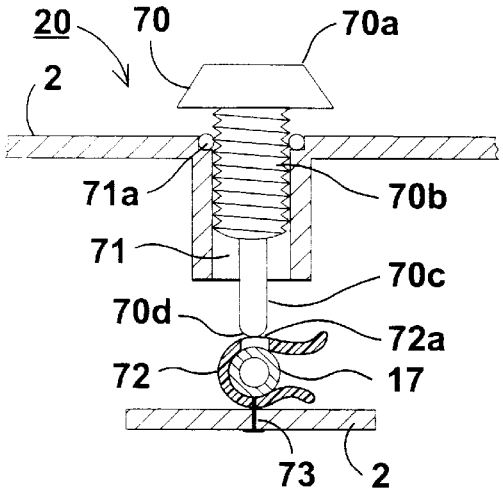
FIG. 2 is a sectional view illustrating the flow rate selector included in the toy water gun of FIG. 1.
Figure 2A:
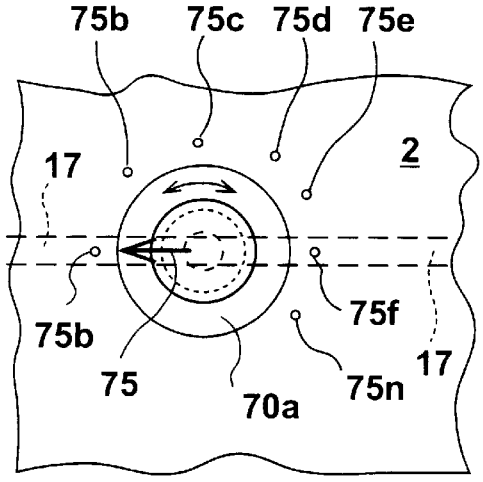
FIG. 2*a* is a top plan view of the flow rate selector of FIG. 2.
Figure 3:
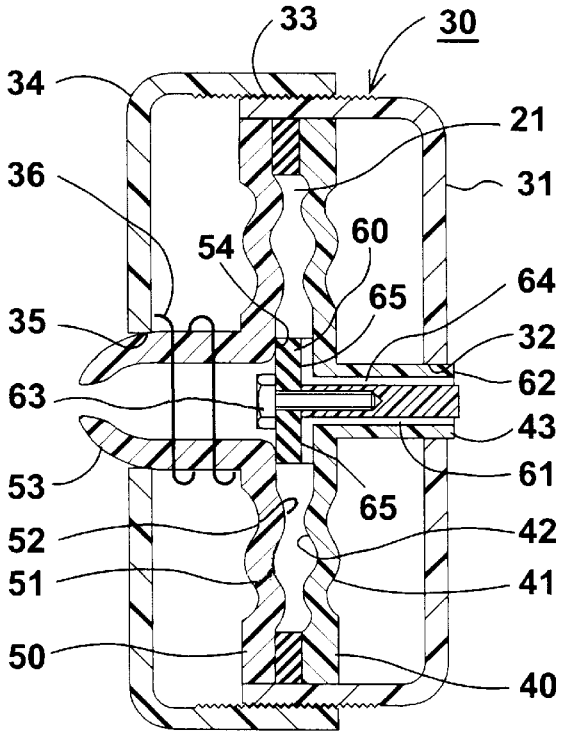
FIG. 3 illustrates a unit incorporating the expansible chamber, the pressure-responsive valve, and the opening pressure selector, in the toy water gun of FIG. 1.

FIGS. 2 and 2*a* illustrate a preferred construction of the flow rate selector 20 in FIG. 1; whereas FIG. 3 illustrates a preferred construction of a compact unit incorporating the expansible chamber 21, the pressure responsive valve 22, and the presettable range selector 23 in FIG. 1. It will be appreciated, however, that other constructions may be used for each of the above devices 20, 21, 22 and 23.

The unit illustrated in FIG. 3 includes a housing 30 closed at one end by an end wall 31 formed with an opening 32 for receiving the inlet to the expansible chamber 21. The opposite end of housing 30 is open and is formed with external threads 33, which receive a cover 34 closing that end of the housing and formed with an opening 35 for receiving the outlet of the expansible chamber. A spring 36, interposed between cover 34 and the expansible chamber 21, is effective, upon threading the cover, to apply spring force restraining the expansion of the chamber according to the degree of threading of the cover on the housing.

Expansible chamber 21 is in the form of a bellows of the type developed by Peretz Rosenberg and described in his Patent Applications 115969 and 121380. It is defined by two circular plates 40, 50 attached together and sealed around their outer peripheries. Plate 40 includes an outer face 41, an inner face 42, and an inlet connector sleeve 43 passing through opening 32 in housing 31, for inletting the water into chamber 21; whereas plate 50 includes an outer face 51, an inner face 52, and an outlet 53 passing through opening 35 in cover 34 for discharging the water from chamber 21.

Both faces 41, 42 of plate 40 are formed with flat outer margins and with a plurality of concentric recesses decreasing in diameter inwardly from the margin towards the central sleeve 43. The recesses in the inner face 42 are aligned with the surfaces between the recesses in the outer face 41. Plate 50 is of similar construction, with the concentric circular recesses on its inner face 52 being aligned with the recesses on the inner face 42 of plate 40.

Plate 50 is further formed with a flat annular surface 54 coaxial with the outlet connector sleeve 53. Flat annular surface 54 serves as a valve seat in cooperation with a deformable membrane 60 located within chamber 21 for controlling the flow of water from that chamber via the outlet connector 53. Deformable membrane 60 is fixed to the inner end of a stem 61 by a pin 62 having an enlarged head 63. Stem 61 is formed with a plurality of axially-extending, circumferentially-spaced, grooves 64 leading to a plurality of radial grooves 65 in the inner face of plate 40 extending to points outwardly of membrane 60 so as to permit fluid to flow into chamber 21 via inlet connector 32.

The foregoing parts are dimensioned so that, in the absence of control by the flow rate selector 20 (FIG. 1), grooves 64 and 65 provide a greater flow rate into chamber 21 than the discharge rate from that chamber provided by the outlet 53. As will be described more particularly below, the two bellows plates 40, 50, and deformable membrane 60 mounted within them, together act as a snap-action valve controlled by the flow rate selector 20 (FIG. 1) to produce either a continuous stream discharge from the outlet connector 53, or a plurality of short squirt discharges spaced as desired.

Figure 3A:
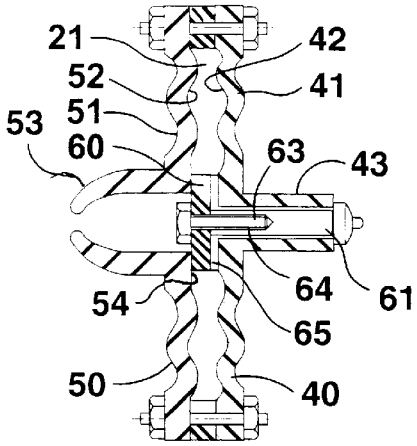
FIGS. 3*a*, 3*b* and 3*c* illustrate three stages of operation of the unit shown in FIG. 3.
Figure 3B:
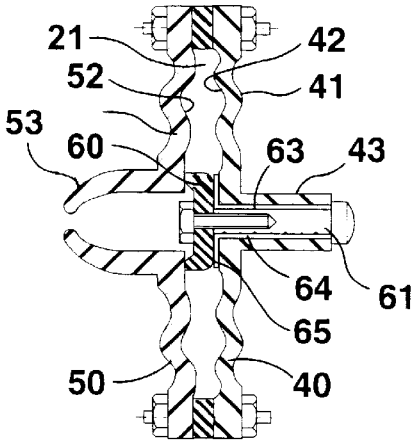
Figure 3C:
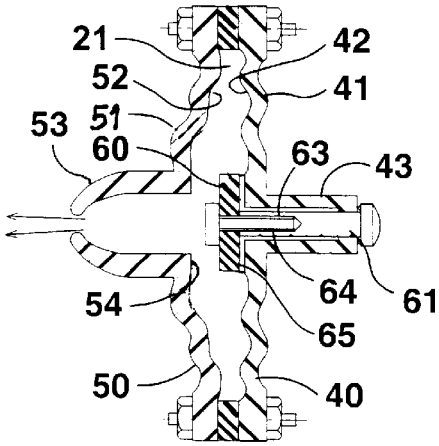

The manner in which bellows plates 40, 50 and membrane 60 operate as a snap-action valve is more particularly illustrated in FIGS. 3*a*–3*c*. Thus, when the valve is closed (FIG. 3*a*), the water flows into chamber 21 via inlet connector 43 and grooves 64, 65, causing the pressure within chamber 21 to build up and the chamber to expand. The increased pressure within chamber 21 firmly presses the outer periphery of membrane 60 against the valve seat 54 of bellows plate 50, thereby maintaining the valve in a closed condition.

As the pressure within chamber 21 builds up, the central regions of the two bellows plates 40, 50 are displaced outwardly to expand the bellows. However, since the central region in the outer face of membrane 60 is exposed to the atmosphere via the outlet 53, the outer periphery of the membrane will deform with the displacement of plates 40, 50, to maintain the valve closed (FIG. 3*b*). This continues until the displacement of the plates causes the outer periphery of the membrane to separate from the valve seat 54 of plate 50 to open the outlet 53. When this ocurrs, the valve opens with a snap-action to produce a rapid discharge of water from chamber (FIG. 3*c*) 21, by the energy stored in plates 40, 50 during the expansion of the bellows.

Flow rate selector 20 controls the inlet flow rate of the water via inlet connector 43 into chamber 21. If the inlet flow rate is equal to (or greater than) the outlet flow rate from that chamber permitted by the outlet 53, the pressure within chamber 21 will be maintained (or increased) so that membrane 60 will remain open, thereby producing a continuous stream discharge.

On the other hand, if the inlet rate permitted by selector 20 is significantly less than the outlet rate, the pressure within chamber 21 will immediately drop after the initial discharge, thereby permitting the two bellows plates 40, 50, to snap back to their original condition (FIG. 3*a*), wherein membrane 60 closes the outlet opening defined by the outlet 53, thereby producing a short squirt discharge. As water is continuously fed into chamber 21, the pressure within that chamber again builds up until the point is reached wherein the valve again opens with a snap-action, to produce another short squirt discharge; and so on as long as the water is fed into chamber 21 under pressure.

Flow rate selector 20 thus may be used to select one of these two modes of operation, and also the interval between the short squirt discharges during the latter mode of operation.

FIGS. 2 and 2*a* illustrate a preferred construction which may be used for the flow rate selector 20. It includes a threaded pin 70 threadedly received within a socket 71 formed in housing 2, in alignment with tube 17 feeding the water from the pump cylinder 11 to the discharge end of the water pistol. Tube 17, or at least the portion of it aligned with pin 70, is made of deformable material so as to be deformable inwardly by pin 70 when threaded into the housing. Tube 17 is preferably retained in place by a plastic clip or sleeve 72 fixed by fasteners 73 to the opposite side of the housing 2.

Pin 70 includes an enlarged head or knob 70*a* externally of housing 2 for grasping by the user, a large-diameter shank section 70*b* threadedly received within socket 71 of housing 2, and a smaller-diameter shank section 70*c* passing through an opening 72*a* in the plastic sleeve 72, and having a rounded tip 70*d* engagable with the tube 17 to deform the tube according to the degree of threading of pin 70 in socket 71. An O-ring 71*a* inserted between shank section 70*b* of pin 70 and the wall of housing 2 defining socket 71, prevents leakage of water from the reservoir 5 within the water pistol.

Pin 70 may thus be rotated to raise its tip 70*d* out of contact with feed tube 17 to produce a maximum inflow of water into the expansible chamber 21, or to lower its tip to deform the feed tube in order to restrict the inflow rate as desired. Producing a maximum inflow, i.e. at a rate greater than the outflow rate from bellows chamber 21, will retain the valve open and will thereby produce a continuous stream discharge; whereas presetting pin 70 to pinch the water feed tube 17 sufficiently to restrict the flow inletted into bellows chamber 21 to a rate below the rate outletted from the bellows when the valve is open (FIG. 3*c*), will produce short squirt discharges time-spaced from each other according to the reduced inletted flow rate.

The outer surface of pin 70 may be provided with an arrow 75*a*–75*n* (FIG. 2*a*) cooperable with markings on the outer surface of housing 2 to indicate the control effected by the flow rate selector, from a continuous stream indicated by marking 75*a*, to short squirt spaced in time according to the markings 75*b*–75*n*.

The user may thus select, not only a continuous stream mode of operation, by rotating pin 70 to align its arrow 75 with marking 75*a*, but also a rapid-fire mode of operation or an individual-fire mode of operation by rotating pin 70 to align its arrow 75 with one of the markings 75*b*–75*n*.

It will also be appreciated that for any one of the foregoing modes of operation, the velocity, and therefore the range, of the discharge can be preselected by rotating cover 34 of the unit illustrated in FIG. 3 to increase or decrease the pressure applied by spring 36 against the two bellows plates 40, 50, and thereby to preset the opening pressure of the valve defined by membrane 60. The latter feature is particularly advantageous in enabling the user to produce a maximum discharge range according to the level of force the user is capable of producing when pivotting handle 7 of the hand-operated pump within the pistol.

The unit illustrated in FIG. 3 may be attached in any suitable manner (e.g., by bayonet pins and slots, threads, friction-fit, etc.) to the end of barrel 4 in communication with the feed tube 17. If it is desired to produce larger discharges, one or more bellows units, such as described in Rosenberg Israel Patent Application No. 115969 (U.S. Pat. No. 5,950,676) may also be attached to thereby increase the effective volume of the expansible chamber, with the unit of FIG. 3 being the end unit since it acts not only as an expansible chamber, but also as a snap-action valve controlling the discharge.

While the invention has been described with respect to a specific construction, it is to be understood that the illustrated construction is set forth merely for purposes of example, and that many variation and modifications may be made. For example, the expansible chamber 21 could be of the conventional, multiple-pleated bellows construction, an inflatable bladder, a piston-cylinder assembly etc.; the pressure-responsive valve 22 could be of other valve constructions which are normally closed but automatically open, preferably with a snap-action, in response to a predetermined pressure; and the flow rate selector 20 could be a presettable, or a fixed, labyrinth-type flow restrictor, such as commonly used in drip irrigation. Also, the invention could be incorporated in other types of toy water guns, such as toy rifles, or in other types of water discharge devices, such as dental devices for cleaning the teeth or massaging the gums. Further, features of the present invention, such as the provision of the flow rate selector 20 and the presettable range selector 23, could be included in water irrigation systems.

Many other variations and applications of the invention will be apparent.

What is claimed is:

1. A water discharge device, comprising:

a portable housing containing a reservoir for a quantity of water;

a discharge control for controlling the discharge of water from the housing;

and a hand-operated pump for manually pumping water from the reservoir through the discharge control;

said discharge control including an expansible chamber having an inlet connected to said pump, an outlet through which the water is discharged, and a pressure-responsive valve controlling said outlet;

said valve being normally closed to permit expansion of said reservoir and a build-up of water pressure therein during the pumping of water by said pump into said reservoir, but automatically opening when a predetermined pressure is reached in said chamber to discharge water therefrom through said outlet.

2. The device according to claim 1, wherein said discharge control further includes a manually presettable selector for presetting said predetermined opening pressure of said valve, thereby enabling presetting the velocity, or range, of the water discharge through said outlet.

3. The device according to claim 1, wherein said discharge control further includes a flow restrictor for restricting the flow into said chamber to a lower rate than out of said chamber through said outlet, such that immediately upon the discharge of water from the chamber, said valve automatically recloses until said predetermined opening pressure is again reached to open the valve.

4. The device according to claim 3, wherein said discharge control further includes a manually presettable flow rate selector for presetting the flow restrictor to a rate which is either sufficiently high to produce a continuous stream discharge through the outlet during the operation of the pump, or sufficiently low to produce a plurality of short squirt discharges through the outlet during the operation of the pump.

5. The device according to claim 4, wherein said flow rate selector may be manually preset to produce a selected one of a plurality of low discharge rates to thereby enable preselection of the time intervals between said short squirt discharges.

6. The device according to claim 4, wherein said hand-operated pump is connected to said expansible chamber by a deformable tube, and said flow rate selector includes a manually presettable member engagable with said tube to deform it and thereby to restrict the water flow therethrough to said chamber.

7. The device according to claim 6, wherein said manually presettable member is a threaded pin having a shank threaded into said housing into engagement with said deformable tube, and an enlarged head located externally of the housing for engagement by a user's fingers to rotate said shank.

8. The device according to claim 1, wherein said expansible chamber is a bellows having an inlet on one wall connected to said pump, and an outlet on an opposed wall controlled by said valve.

9. The device according to claim 8, wherein said valve includes a valve member fixed to said one wall and normally closing said outlet in said opposed wall, but automatically opening said outlet by the expansion of said bellows when said predetermined opening pressure is reached by the water within the bellows.

10. The device according to claim 9, wherein said discharge control further includes a manually presettable selector for presetting said predetermined opening pressure of said valve, thereby enabling presetting the velocity or range of the water discharge through said outlet.

11. The device according to claim 10, wherein said opening pressure selector includes a housing closed at one end to enclose said first wall of the bellows, and formed with an opening for the inlet to said bellows, the opposite end of said housing being open and formed with threads;

a rotatable cover threadedly received over the open end of said housing and formed with an opening for receiving the outlet of said bellows;

and a spring within said housing and effective, upon threading said cover over the open end of said housing, to apply a spring force restraining the expansion of the bellows according to the degree of threading of said cover over said open end of the housing.

12. The device according the claim 11 , wherein said spring is interposed between said cover and said second wall of the bellows formed with said outlet.

13. The device according to claim 1, wherein said portable housing includes a handle to be grasped by the user, and said hand-operated pump includes a lever pivotally mounted to said handle and graspable by the user when grasping the handle for operating the pump.

14. The device according to claim 13, wherein said pump further includes a cylinder incorporated within said handle, and a piston coupled to said lever and movable within said cylinder.

15. The device according to claim 1, wherein said housing is in the shape of a toy water gun.

16. A water discharge device, comprising:

a portable housing containing a reservoir for a quantity of water;

a discharge control for controlling the discharge of water from the housing;

and a hand-operated pump for manually pumping water from the reservoir through the discharge control;

said discharge control including an inlet connected to said pump, an outlet through which the water is discharged, and a pressure-responsive valve controlling said outlet;

said valve being normally closed but automatically opening when a predetermined pressure is reached in said chamber to discharge water therefrom through said outlet;

said discharge control further including a manually presettable selector for presetting said predetermined opening pressure of said valve.

17. A toy water gun, comprising:

a housing containing a reservoir for a quantity of water;

a discharge control for controlling the discharge of water from the housing;

and a hand-operated pump for manually pumping water from the reservoir through the discharge control;

said discharge control including an expansible chamber having an inlet connected to said pump, an outlet through which the water is discharged, and a pressure-responsive valve controlling said outlet;

said valve being normally closed to permit expansion of said reservoir and a build-up of water pressure therein during the pumping of water by said pump into said reservoir, but automatically opening when a predetermined pressure is reached in said chamber to discharge water therefrom through said outlet.

18. The toy water gun according to claim 17, wherein said discharge control further includes a manually presettable selector for presetting said predetermined opening pressure of said valve, thereby enabling presetting the velocity, or range, of the water discharge through said outlet.

19. The toy water gun according to claim 17, wherein said discharge control further includes a flow restrictor for restricting the flow into said chamber to a lower rate than out of said chamber through said outlet, such that immediately upon the discharge of water from the chamber, said valve automatically recloses until said predetermined opening pressure is again reached to open the valve.

20. The toy water gun according to claim 19, wherein said discharge control further includes a manually presettable flow rate selector for presetting the flow restrictor to a rate which is either sufficiently high to produce a continuous stream discharge through the outlet during the operation of the pump, or sufficiently low to produce a plurality of short squirt discharges through the outlet during the operation of the pump.

* * * * *